US007495506B1

(12) United States Patent
Carper

(10) Patent No.: US 7,495,506 B1
(45) Date of Patent: Feb. 24, 2009

(54) HEADROOM COMPENSATED LOW INPUT VOLTAGE HIGH OUTPUT CURRENT LDO

(75) Inventor: Scott D. Carper, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 155 days.

(21) Appl. No.: 11/232,644

(22) Filed: Sep. 22, 2005

(51) Int. Cl.
*G05F 1/10* (2006.01)

(52) U.S. Cl. ..... 327/540; 327/534

(58) Field of Classification Search ..... 327/534–535, 327/540–543; 323/312–316
See application file for complete search history.

(56) References Cited

U.S. PATENT DOCUMENTS

| | | | | |
|---|---|---|---|---|
| 4,754,168 | A | 6/1988 | Liran | 327/536 |
| 5,262,871 | A * | 11/1993 | Wilder et al. | 348/307 |
| 5,936,433 | A | 8/1999 | Holloway | 327/75 |
| 5,952,701 | A | 9/1999 | Bulucea et al. | 257/407 |
| 6,377,112 | B1 | 4/2002 | Rozsypal | 327/534 |
| 6,424,203 | B1 * | 7/2002 | Bayadroun | 327/536 |
| 6,515,534 | B2 | 2/2003 | Dabral | 327/534 |
| 6,628,159 | B2 * | 9/2003 | Voldman | 327/534 |
| 6,646,495 | B2 * | 11/2003 | Perez | 327/541 |
| 6,869,216 | B1 | 3/2005 | Holloway et al. | 374/170 |
| 7,005,911 | B1 * | 2/2006 | Om'mani | 327/408 |
| 7,183,837 | B2 * | 2/2007 | Fujiwara | 327/537 |
| 2002/0075707 | A1 * | 6/2002 | Dietrich et al. | 363/60 |

OTHER PUBLICATIONS

Assaderaghi, F. et al. (1994) "A Dynamic Threshold Voltage MOSFET (DTMOS) for Ultra-Low Voltage Operation," *IEDM Technical Digest*, pp. 809-812.

Hazucha, P. et al. (2005) "Area-Efficient Linear Regulator With Ultra-Fast Load Regulation," *IEEE Journal of Solid-State Circuits*, 40(4):933-940.

Kioi, K. et al. (1997) "Forward Body-Bias MOS (FBMOS) Dual Rail Logic Using an Adiabatic Charging Technique with Sub -0.6V Operation," *Electronics Letters*, 33(14):1200-1201.

Kobayashi, T. et al. (1994) "Self-Adjusting Threshold-Voltage Scheme (SATS) for Low-Voltage High-Speed Operation," *IEEE 1994 Custom Integrated Circuits Conference*, pp. 271-274.

Kotaki, H. et al. (1996) "Novel Bulk Dynamic Threshold Voltage MOSFET (B-DTMOS) with Advanced Isolation (SITOS) and Gate to Shallow-Well Contact (SSS-C) Processes for Ultra Low Power Dual Gate CMOS," *International Electron Devices Meeting (IEDM)*, pp. 459-462.

(Continued)

*Primary Examiner*—Lincoln Donovan
*Assistant Examiner*—Thomas J Hiltunen
(74) *Attorney, Agent, or Firm*—Darby & Darby P.C.; Matthew M. Gaffney

(57) ABSTRACT

A low-dropout regulator is provided. The low-dropout regulator includes a p-type depletion transistor as a pass device. The low-dropout regulator further includes switch circuitry and a charge pump that provides, at its output, a voltage greater than VDD. The source of the p-type depletion transistor is coupled to VDD. Under normal operating conditions, the bulk of the p-type depletion transistor is coupled to the source of the p-type depletion transistor. However, if the voltage at the gate of the p-type depletion transistor gets close to VDD, the switch circuitry causes the bulk of the p-type transistor to be coupled to the output of the charge pump instead.

20 Claims, 4 Drawing Sheets

OTHER PUBLICATIONS

Kuroda, T. et al. (1996) "Threshold-Voltage Control Schemes through Substrate-Bias for Low-Power High-Speed CMOS LSI Design," *Journal of VLSI Signal Processing Systems,* 13:191-201.

Maksimovic, D. et al. (1999) "Switched-Capacitor DC-DC Converters for Low-Power On-Chip Applications," *IEEE,* pp. 54-59.

Rincon-Mora, G. et al. (1998) "A Low-Voltage, Low Quiescent Current, Low Drop-Out Regulator," *IEEE Journal of Solid-State Circuits,* 33(1):36-44.

Sakurai, T. et al. (1997) "Low-Power CMOS Design through $V_{TH}$ Control and Low-Swing Circuits," *Proceedings of ACM/IEEE International Symposium on Low Power Electronics and Design,* pp. 1-6.

Tantawy, R. et al. (2004) "Performance Evaluation of CMOS Low Drop-Out Voltage Regulators," *The 47th IEEE International Midwest Symposium on Circuits and Systems,* pp. 141-144.

Wann, H.C. et al. (1995) "Channel Doping Engineering of MOSFET with Adaptable Threshold Voltage Using Body Effect for Low Voltage and Low Power Applications," *1995 International Symposium on VLSI Technology, Systems and Applications, Proceedings of Technical Papers,* pp. 159-163.

Wrathall, R. et al. (1994) "The Design of an Automotive Low Drop Out Regulator IC Utilizing a Depletion Mode High Voltage DMOS Pass Element," *Workshop on Power Electronics in Transportation, Oct. 20-21, Detroit, Michighan,* pp. 17-22.

* cited by examiner

HEADROOM COMPENSATED LOW INPUT VOLTAGE HIGH OUTPUT CURRENT LDO

FIELD OF THE INVENTION

The invention is related to low-dropout regulators, and in particular, to a low-dropout regulator in which the pass transistor is a p-type depletion transistor having a bulk that is switched to a voltage above the source if the gate voltage of the transistor gets close to the supply rail.

BACKGROUND OF THE INVENTION

A linear regulator operates to provide a regulated output voltage from an input voltage. A linear regulator includes a pass transistor to provide the regulated output voltage from the input voltage, where the base or gate of the pass transistor is adjusted through negative feedback to regulate the output voltage.

A typical linear regulator requires a fair amount of headroom to operate. However, a low-dropout regulator (LDO) is designed to operate with a low dropout compared to a typical linear regulator (where dropout refers to the voltage difference between the input voltage at the regulated output voltage). In a low-dropout regulator, the pass transistor is typically a p-type enhancement mode transistor.

BRIEF DESCRIPTION OF THE DRAWINGS

Non-limiting and non-exhaustive embodiments of the present invention are described with reference to the following drawings, in which.

DETAILED DESCRIPTION

Figure 1:
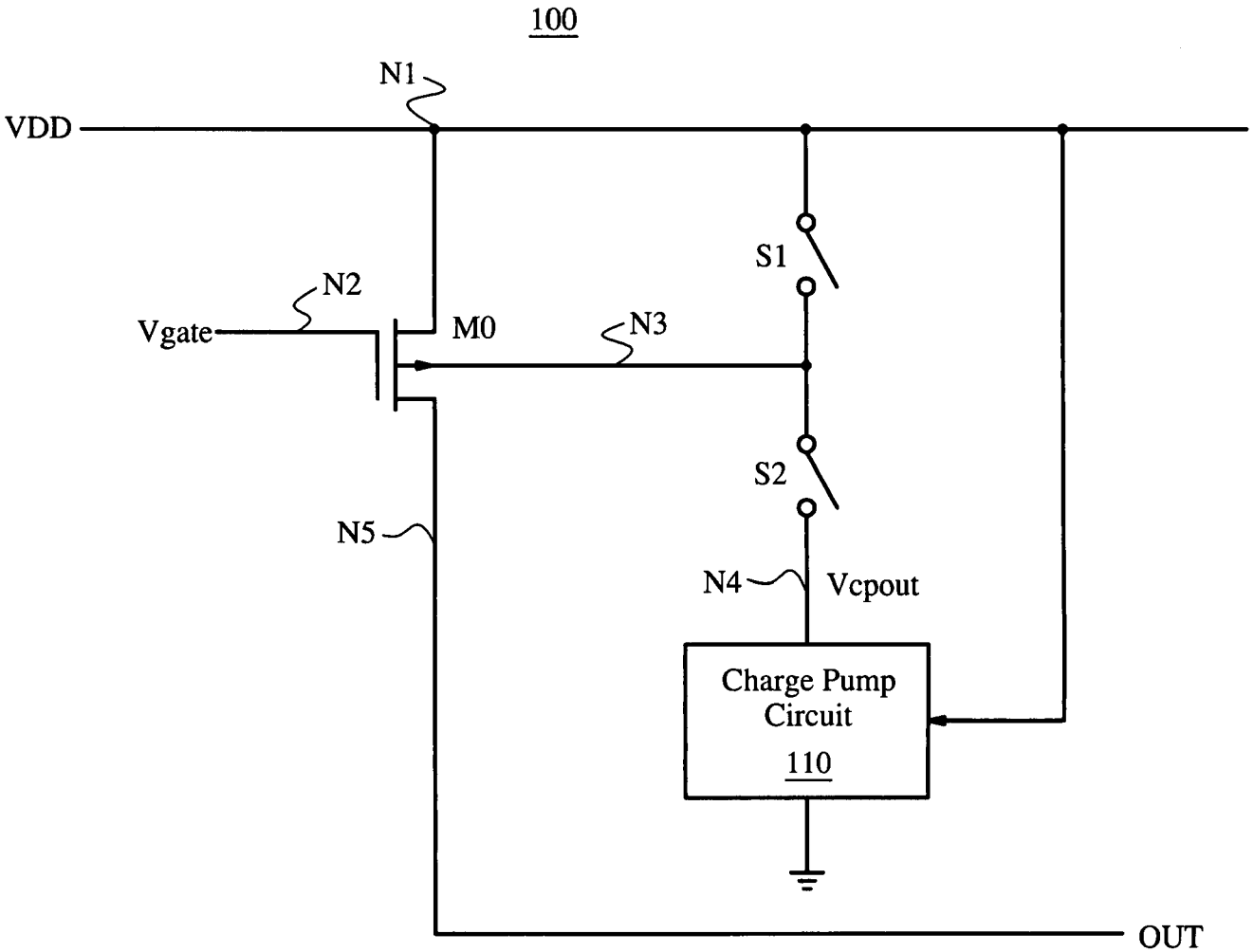
FIG. 1 illustrates a block diagram of a circuit.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" includes plural reference, and the meaning of "in" includes "in" and "on." The phrase "in one embodiment," as used herein does not necessarily refer to the same embodiment, although it may. The term "coupled" means at least either a direct electrical connection between the items connected, or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data, or other signal. Where either a field effect transistor (FET) or a bipolar transistor may be employed as an embodiment of a transistor, the scope of the words "gate", "drain", and "source" includes "base", "collector", and "emitter", respectively, and vice versa.

Briefly stated, the invention is related to a low-dropout regulator that includes a p-type depletion transistor as a pass device. The low-dropout regulator further includes switch circuitry and a charge pump that provides, at its output, a voltage greater than VDD. The source of the p-type depletion transistor is coupled to VDD. Under normal operating conditions, the bulk of the p-type depletion transistor is coupled to the source of the p-type depletion transistor. However, if the voltage at the gate of the p-type depletion transistor gets close to VDD, the switch circuitry causes the bulk of the p-type transistor to be coupled to the output of the charge pump instead.

FIG. 1 illustrates a block diagram of circuit 100, which is arranged for operation in low supply voltage conditions. Circuit 100 includes p-type depletion transistor M0, switch circuit S1, switch circuit S2, and charge pump circuit 110.

Transistor M0 is a p-type depletion transistor. For example, in one embodiment, transistor M0 is a PMOSFET in which the channel semiconductor is doped such that there is channel conduction even when the gate voltage is equal to the supply voltage. In other embodiments, transistor M0 may be a JFET, or the like.

Additionally, charge pump circuit 110 is operable to provide charge pump output voltage Vcpout at node N4 such that charge pump output voltage Vcpout is greater than power supply voltage VDD. In one embodiment, Vcpout is approximately equal to N*VDD, wherein N is an integer that is greater than one.

Also, transistor M0 has a source that is coupled to node N1, a gate that is coupled to node N2, a bulk (e.g. Nwell) that is coupled to node N3, and a drain that is coupled to node N5. Switch circuit S1 and S2 are arranged to couple node N3 to either node N1 or node N4, depending on gate voltage Vgate. Further, switch circuits S1 and S2 are controlled such that, during normal operating conditions, node N3 is coupled to node N1 (i.e., switch circuit S1 is closed and switch circuit S2 is open). However, if voltage Vgate is relatively close to an upper limit of a voltage swing for voltage Vgate, then node N3 is coupled to node N4 (i.e. switch circuit S1 is open and switch circuit S2 is closed).

In one embodiment, switch circuits S1 and S2 each consist of a transistor. In other embodiments, other implementations of switch circuits S1 and S2 may be employed.

In one embodiment, by switching the bulk of transistor M0 to node N4, reverse bias is applied across the depletion region formed by the inversion layer and the bulk, causing the threshold voltage $V_{TP}$ of transistor M0 to increase.

Transistor M0, a p-type depletion transistor, requires relatively little gate bias voltage to deliver current to a load. Circuit 300 allows p-type depletion transistor M0 to deliver light load current (e.g. sub-threshold current) or turn off under the appropriate conditions while operating out of a single supply. In one embodiment, charge pump circuit 310 is designed to handle only light load currents and is accordingly sized relatively small.

Figure 4:
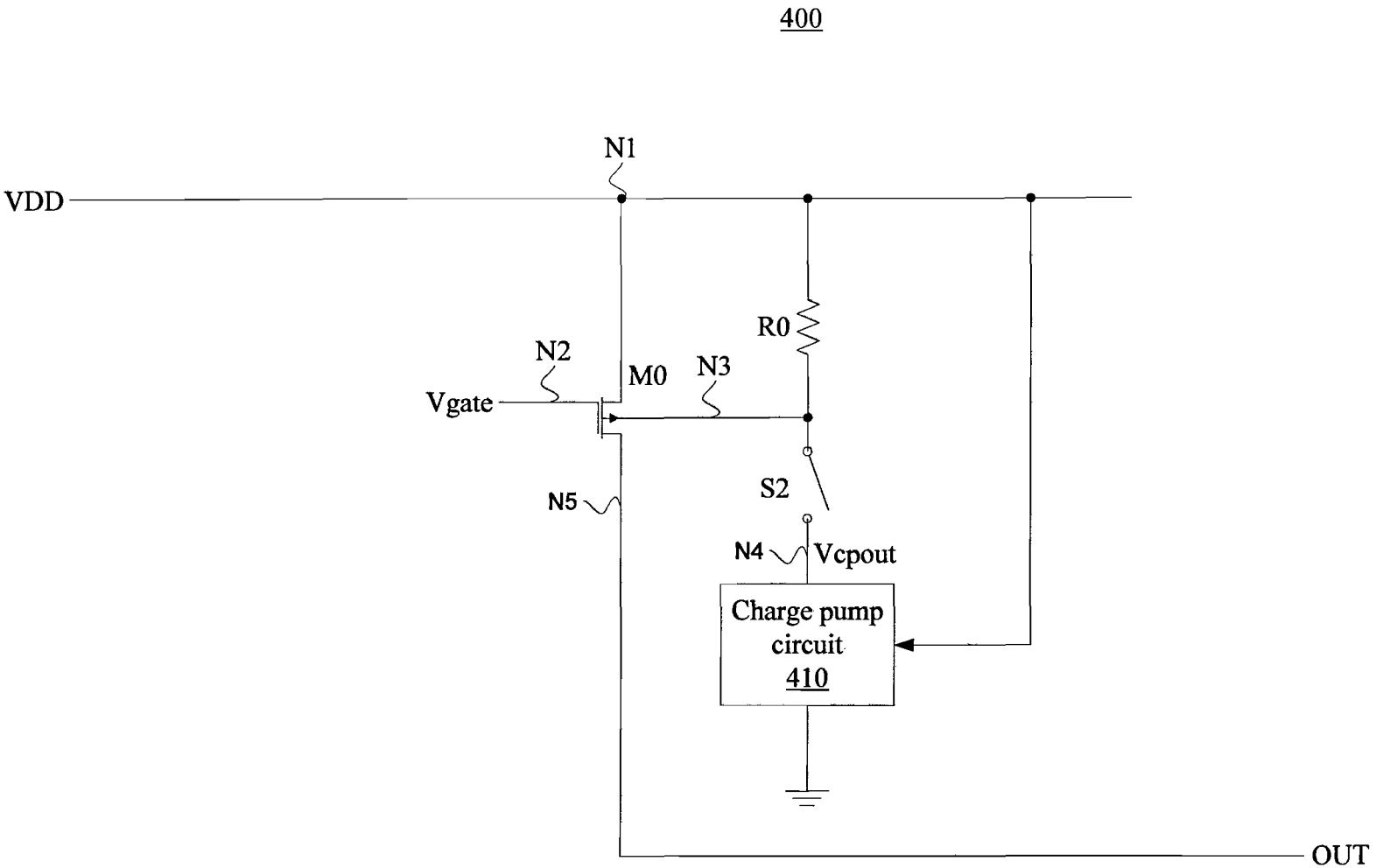
FIG. 4 shows a block diagram of an embodiment of the circuit of FIG. 1, arranged in accordance with aspects of the present invention.

Although one embodiment of switch circuitry for switch the bulk of transistor M0 is illustrated in FIG. 1, other embodiments of the switch circuitry may be employed within the scope and spirit of the invention. For example, in one embodiment, switch circuit S1 may be replaced with a pull-up resistor (as illustrated in FIG. 4 in one embodiment). Also, although switch circuits S1 and S2 are shown as two separate switches, in one embodiment, the two separate switches may be implemented by one single pole double throw switch.

Figure 2:
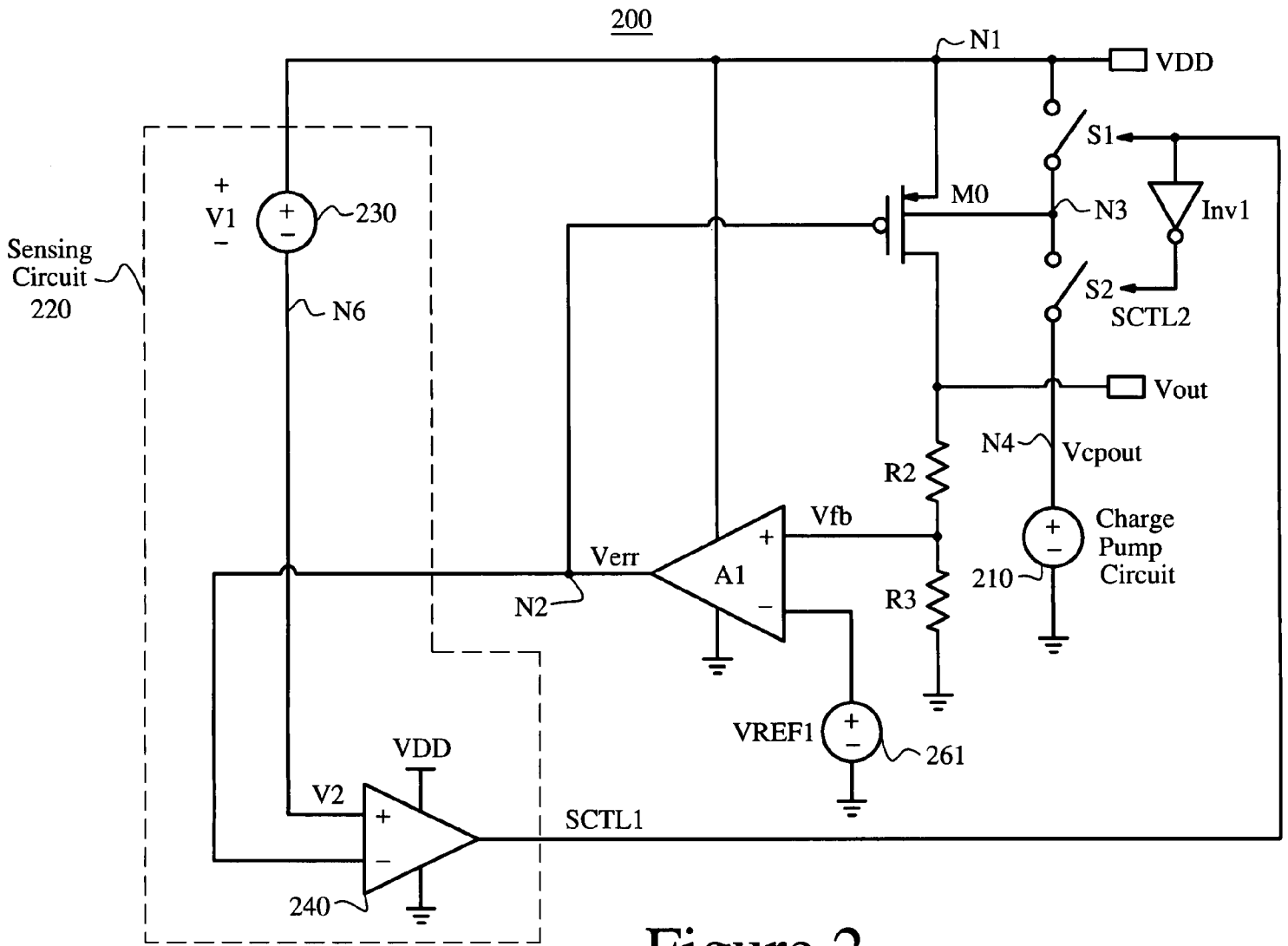
FIG. 2 shows a block diagram of an embodiment of a low-dropout regulator that is an embodiment of the circuit of FIG. 1.

FIG. 2 illustrates an embodiment of low-dropout regulator 200, which is an embodiment of circuit 100 of FIG. 1. LDO 200 further includes error amplifier A1, resistor R2, resistor R3, inverter Inv1, reference voltage circuit 261, and sensing circuit 220. In one embodiment, sensing circuit 220 includes voltage source circuit 230 and comparator 240.

Transistor M0 operates as a pass device to provide regulated output voltage Vout from input voltage VDD. In one embodiment, VDD is about 1.4V. In other embodiments, other voltages may be employed. Also, reference voltage source 261 is operable to provide reference voltage VREF1. Resistors R2 and R3 operate as a voltage divider to provide feedback voltage Vfb from output voltage Vout. Error amplifier A1 is operable to provide error voltage Verr based on the difference between feedback voltage Vfb and reference voltage VREF1.

Error voltage Verr is an embodiment of voltage Vgate of FIG. 1. In one embodiment, sensing circuit 220 is operable to detect whether error voltage Verr is relatively close to an upper limit of a voltage swing for voltage Verr. If so, sensing circuit 220 causes switch circuit S1 to open and switch circuit S2 to close.

In one embodiment, sensing circuit 220 includes voltage source circuit 230 and comparator 240. In this embodiment, voltage source 230 is arranged to provide a voltage drop of V1 between nodes N1 and N6. In one embodiment, voltage source 230 includes a bandgap reference and a voltage divider, a bandgap reference and a resistor ladder with one or more tap points, or the like, to provide the voltage drop of V1. Accordingly, the voltage at node N6, V2, is given by V2=VDD−V1. In one embodiment, V1 is approximately equal to the saturation voltage (Vsat) of transistor M0. In one embodiment, V1 is a pre-determined voltage from about 50 mV to about 200 mV. For example, in one embodiment, V1 is 100 mV.

Comparator 240 is arranged to trip if error voltage Verr reaches voltage V2. If comparator 240 trips, then switch control signal SCTL1 is asserted. Otherwise, switch control signal SCTL1 is unasserted. Further, inverter Inv1 is operable to provide switch control signal SCTL2 by inverting switch control signal SCTL1. If signal SCTL1 is asserted, switch circuit S1 is closed and switch circuit S2 is open. If signal SCTL1 is unasserted, switch circuit S1 is open and switch circuit S2 is closed.

In one embodiment, hysteresis is provided for the comparison. For example, in one embodiment, V1 is 100 mV, and 100 mV of hysteresis is employed. In this embodiment, comparator 240 trips, asserting signal SCTL1, if voltage Verr reaches voltage VDD−100 mV. If comparator 240 trips, signal SCTL1 remains asserted until voltage V2 drops below VDD−200 mV.

Although one embodiment of circuit 200 is illustrated in FIG. 2, other embodiments are within the scope and spirit of the invention.

For example, although an LDO is illustrated in FIG. 2, the invention is not so limited. For example, embodiments of the invention may include a logic circuit such as a CMOS inverter where the p-type transistor is a p-type depletion transistor whose bulk is modulated between VDD and charge pump output voltage Vcpout.

Similarly, although a particular embodiment of sensing circuit 220 is illustrated in FIG. 2, other embodiments of sensing circuit 220 may be used to determine when to switch the bulk of transistor M0. Also, as previously discussed, switch circuits S1 and S2 may be replaced with alternative switch circuitry which provides the same function of switching the bulk of transistor M0 to either voltage VDD or voltage Vcpout based on the output of sensing circuit 220.

Figure 3:
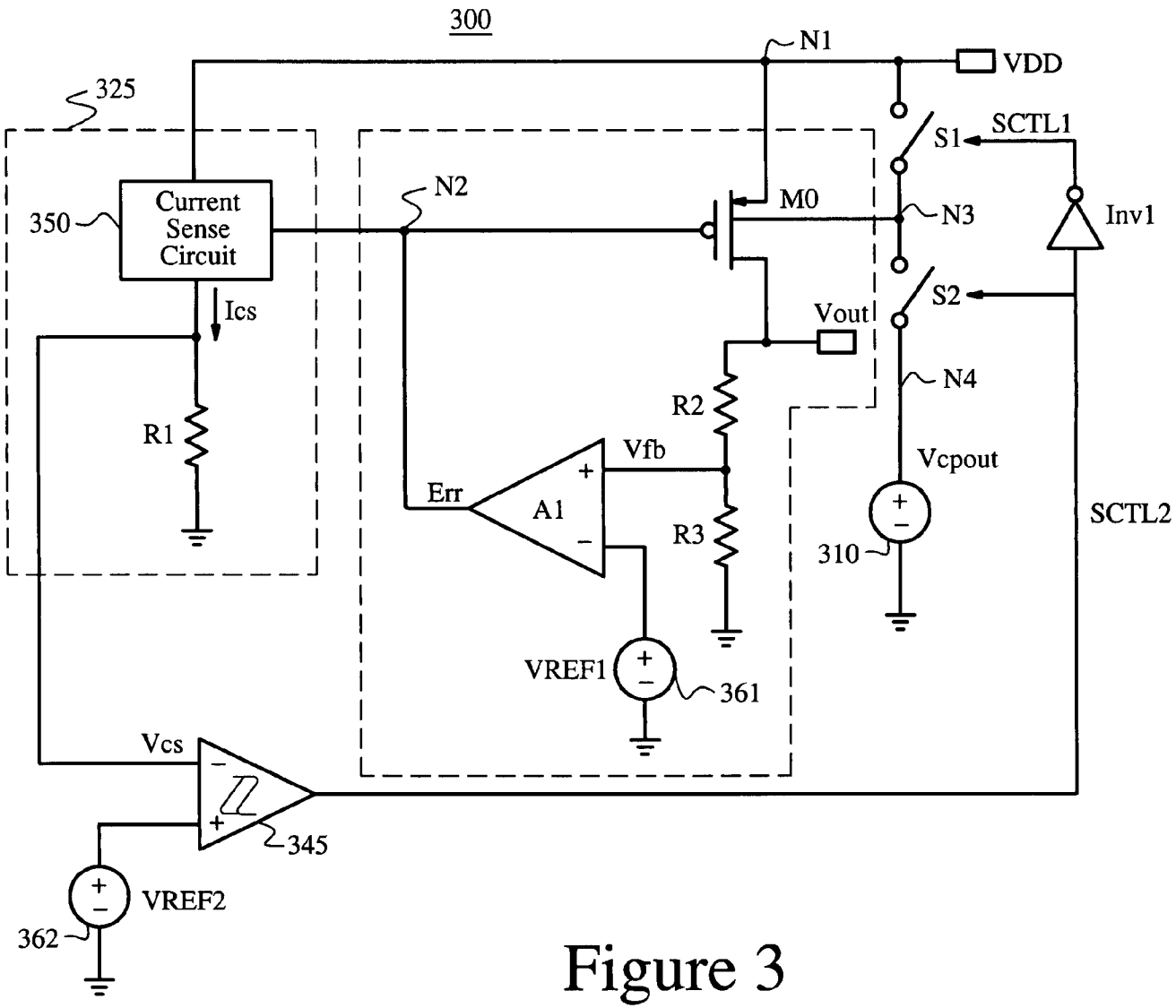
FIG. 3 illustrates another embodiment of a low-dropout regulator that is an embodiment of the circuit of FIG. 1.

FIG. 3 illustrates another embodiment of a low-dropout regulator 300, which is an embodiment of circuit 100 of FIG. 1. Components in FIG. 3 may operate in a similar manner to similarly-named components previously described, and may operate in a different manner in some ways. LDO 300 further includes error amplifier A1, resistor R2, resistor R3, inverter Inv1, reference voltage circuits 361 and 362, comparator 345, and sensing circuit 220. In one embodiment, sensing circuit 320 includes current sense circuit 350 and resistor R1.

In one embodiment, current sense circuit 350 is operable to provide sense current Ics such that current Ics is approximately proportional to the drain current of transistor M0. In one embodiment, current sense circuit 350 is a sense transistor that is arranged in a current mirror relationship with transistor M0. In other embodiments, current sense circuit 350 may be a sense resistor, or the like, and may be arranged in a different manner than shown in FIG. 3. In one embodiment, resistor R1 is operable to provide current sense voltage Vcs from current Ics. In another embodiment, current sense circuit 350 may provide current sense voltage Vcs directly, in which case resistor R1 may be omitted. In yet another embodiment, comparator 345 may be a current comparator, in which case resistor R1 may be omitted.

Reference voltage circuit 362 is operable to provide reference voltage VREF2. Comparator 345 is operable to provide switch enable signal SCTL2 based on a comparison of current sense voltage Vcs and reference voltage VREF2. Inverter Inv1 is operable to provide switch enable signal SCTL1 by inverting switch enable signal SCTL2.

During normal operation, the bulk of transistor M0 is coupled to VDD (i.e. switch circuit S1 is closed, and switch circuit S2 is open). However, if the drain current of transistor M0 drops below a pre-determined value, switch circuit S1 is opened, and switch circuit S2 is closed so that the bulk of transistor M0 is coupled to Vcpout. In one embodiment, Vcpout is 2*VDD. In another embodiment, Vcpout is a multiple of VDD greater than 2*VDD. Transistor M0 may run sub-threshold at very light currents, and error voltage Verr accordingly swings outside of its range, under those conditions. Accordingly, under these conditions, switch circuit S1 is opened and switch circuit S2 is closed to switch the bulk of transistor M0 to a higher voltage than VDD.

The above specification, examples and data provide a description of the manufacture and use of the composition of the invention. Since many embodiments of the invention can be made without departing from the spirit and scope of the invention, the invention also resides in the claims hereinafter appended.

What is claimed is:

1. A circuit for operation with a low supply voltage, comprising:

a p-type depletion transistor having at least a gate, a drain, a source, and a bulk, wherein the source of the p-type depletion transistor is coupled to a power supply node;

a charge pump circuit having at least an input and an output, wherein the input of the charge pump circuit is coupled to the power supply node;

a first switch circuit that is coupled between the bulk of the p-type transistor and the power supply node;

a second switch circuit that is coupled between the bulk of the p-type transistor and the output of the charge pump circuit; and an error amplifier that is coupled to the gate of the p-type depletion transistor, wherein the circuit is a low-dropout regulator circuit, and wherein the p-type depletion transistor operates as a pass transistor.

2. A circuit for operation with a low supply voltage, comprising:

a p-type depletion transistor having at least a gate, a drain, a source, and a bulk, wherein the source of the p-type depletion transistor is coupled to a power supply node;

a charge pump circuit having at least an input and an output, wherein the input of the charge pump circuit is coupled to the power supply node;

a first switch circuit that is coupled between the bulk of the p-type transistor and the power supply node;

a second switch circuit that is coupled between the bulk of the p-type transistor and the output of the charge pump circuit; and a sensing circuit that is operable to provide a switch control signal, and to assert the switch control signal if a drain current of the p-type depletion transistor is less than a pre-determined value, wherein the second switch circuit is arranged to close if the switch control signal is asserted, and to open if the switch control signal is unasserted; and wherein the first switch circuit is arranged to open if the switch control signal is asserted, and to close if the switch control signal is unasserted.

3. The circuit of claim 2, wherein the p-type depletion transistor is a surface-channel-depletion-mode PMOSFET.

4. A circuit for operation with a low supply voltage, comprising:

a p-type depletion transistor having at least a gate, a drain, a source, and a bulk, wherein the source of the p-type depletion transistor is coupled to a power supply node;

a charge pump circuit having at least an input and an output, wherein the input of the charge pump circuit is coupled to the power supply node;

a first switch circuit that is coupled between the bulk of the p-type transistor and the power supply node;

a second switch circuit that is coupled between the bulk of the p-type transistor and the output of the charge pump circuit; and a sensing circuit that is operable to provide a switch control signal, and to assert the switch control signal if an error voltage reaches a voltage that is less than the power supply voltage by a pre-determined amount, wherein the second witch circuit is arranged to close if the switch control signal is asserted, and to open if the switch control signal is unasserted; and wherein the first switch circuit is arranged to open if the switch control signal is asserted, and to close if the switch control signal is unasserted.

5. The circuit of claim 4, wherein the pre-determined amount is a value from about 50 milliVolts to about 200 milliVolts.

6. A circuit for operation with a low supply voltage, comprising:

a p-type depletion transistor having at least a gate, a drain, a source, and a bulk, wherein the source of the p-type depletion transistor is coupled to a power supply node;

a charge pump circuit having at least an input and an output, wherein the input of the charge pump circuit is coupled to the power supply node;

a first switch circuit that is coupled between the bulk of the p-type transistor and the power supply node; and a second switch circuit that is coupled between the bulk of the p-type transistor and the output of the charge pump circuit, wherein the charge pump circuit is operable to provide a charge pump output voltage at the output of the charge pump circuit such that the actual charge pump output voltage is greater than a power supply voltage at the power supply node.

7. A circuit for operation with a low supply voltage, comprising:

a p-type depletion transistor having at least a gate, a drain, a source, and a bulk, wherein the source of the p-type, depletion transistor is coupled to a power supply node;

a charge pump circuit having at least an input and an output, wherein the input of the charge pump circuit is coupled to the power supply node;

a first switch circuit that is coupled between the bulk of the p-type transistor and the power supply node; and a second switch circuit that is coupled between the bulk of the p-type transistor and the output of the charge pump circuit, wherein the charge pump circuit is operable to provide a charge pump output voltage at the output of the charge pump circuit such that the charge pump output voltage is greater than a power supply voltage at the power supply node, the charge pump voltage is at least twice the power supply voltage, and wherein the charge pump voltage is a multiple of the power supply voltage.

8. A low-dropout regulator circuit, comprising:

a pass device including a p-type depletion transistor having at least a gate, a drain, a source, and a bulk, wherein the source of the p-type depletion transistor is coupled to an input voltage node, the p-type depletion transistor is arranged to receive an input voltage at the input voltage node, and wherein the pass device is operable to provide a regulated output voltage;

an error amplifier having at least an output that is coupled to the gate of the p-type depletion transistor, wherein the error amplifier is arranged to provide an error voltage at the output of the error amplifier;

a charge pump circuit having at least an input and an output, wherein the input of the charge pump circuit is coupled to the input voltage node;

a sensing circuit that is operable to provide a switch control signal, and to assert the switch control signal if the error voltage reaches a voltage that is less than the input voltage by a pre-determined amount;

a switch circuit that is arranged such that:

if the switch control signal is asserted the bulk of the p-type depletion transistor is coupled to the output of the charge pump circuit;

else the bulk of the p-type depletion transistor is coupled to the source of the p-type depletion transistor.

9. The low-dropout regulator circuit of claim 8, wherein the pre-determined amount is a value from about 5 milliVolts to about 200 milliVolts.

10. The low-dropout regulator circuit of claim 8, wherein the pre-determined amount is approximately equal to a saturation voltage of the p-type depletion transistor; the input voltage is a power supply voltage of about 1.4 volts; the p-type depletion transistor is a PMOSFET in which a channel semiconductor of the PMOSFET is doped such that there is channel conduction even when the gate voltage of the p-type depletion transistor is equal to the power supply voltage when the bulk of the p-type depletion transistor is coupled to the source of the p-type depletion transistor; the charge pump output voltage is at least 1.5 times the power supply voltage; the low-dropout regulator circuit is biased off of exactly a single supply; the charge pump circuit is sized relatively small such that the charge pump circuit operates with current that is, at most, relatively close to sub-threshold current for the p-type depletion transistor; and wherein the sensing circuit employs hysteresis.

11. A circuit for operation with a low supply voltage, comprising:

a p-type depletion transistor having at least a gate, a drain, a source, and a bulk, wherein the source of the p-type depletion transistor is coupled to a power supply node, wherein the p-type transistor is arranged such that a voltage at the gate of the p-type depletion transistor has a non-negligible voltage swing;

a charge pump circuit having at least an output; and switch circuitry that is arranged such that:

if the voltage at the gate of the p-type depletion transistor is relatively close to an upper limit of a voltage swing for the gate voltage the bulk of the p-type depletion transistor is coupled to the output of the charge pump circuit;

else the bulk of the p-type depletion transistor is coupled to the source of the p-type depletion transistor.

12. The circuit of claim 11, wherein the switch circuitry includes:

a first switch circuit that is coupled between the bulk of the p-type transistor and the power supply node; and a second switch circuit that is coupled between the bulk of the p-type transistor and the output of the charge pump circuit.

13. The circuit of claim 11, wherein the switch circuitry includes:

a resistor that is coupled between the bulk of the p-type transistor and the power supply node; and a switch circuit that is coupled between the bulk of the p-type transistor and the output of the charge pump circuit.

14. The circuit of claim 11, wherein the switch circuitry includes:

a single pole double throw switch common to the bulk of the p-type depletion transistor.

15. A circuit for operation with a low supply voltage, comprising:

a p-type depletion transistor having at least a gate, a drain, a source, and a bulk, wherein the source of the p-type depletion transistor is coupled to a power supply node;

a charge pump circuit having at least an output;

switching circuitry that is arranged such that:

if voltage at the gate of the p-type depletion transistor is relatively close to an upper limit of a voltage swing for the gate voltage the bulk of the p-type depletion transistor is coupled to the output of the charge pump circuit;

else the bulk of the p-type depletion transistor is coupled to the source of the p-type depletion transistor; and an error amplifier that is coupled to the gate of the p-type depletion transistor, wherein the circuit is a low-dropout regulator circuit, and wherein the p-type depletion transistor operates as a pass transistor.

16. A circuit for operation with a low supply voltage, comprising:

a p-type depletion transistor having at least a gate, a drain, a source, and a bulk, wherein the source of the p-type depletion transistor is coupled to a power supply node;

a charge pump circuit having at least an output;

switch circuitry that is arranged such that:

if voltage at the gate of the p-type depletion transistor is relatively close to an upper limit of a voltage swing for the gate voltage the bulk of the p-type depletion transistor is coupled to the output of the charge pump circuit;

else the bulk of the p-type depletion transistor is coupled to the source of the p-type depletion transistor; and a sensing circuit that is operable to provide a switch control signal, and to assert the switch control signal if a drain current of the p-type depletion transistor is less than a pre-determined value, wherein the second switch circuit is arranged to close if the switch control signal is asserted, and to open if the switch control signal is unasserted, and wherein the first switch circuit is arranged to open if the switch control signal is asserted, and to close if the switch control signal is unasserted.

17. A circuit for operation with a low supply voltage, comprising:

a p-type depletion transistor having at least a gate, a drain, a source, and a bulk, wherein the source of the p-type depletion transistor is coupled to a power supply node;

a charge pump circuit having at least an output;

switch circuitry that is arranged such that:

if voltage at the gate of the p-type depletion transistor is relatively close to an upper limit of a voltage swing for the gate voltage the bulk of the p-type depletion transistor is coupled to the output of the charge pump circuit;

else the bulk of the p-type depletion transistor is coupled to the source of the p-type depletion transistor; and a sensing circuit that is operable to provide a switch control signal, and to assert the switch control signal if an error voltage reaches a voltage that is less than the power supply voltage by a pre-determined amount, wherein the second switch circuit is arranged to close if the switch control signal is asserted, and to open if the switch control signal is unasserted; and wherein the first switch circuit is arranged to open if the switch control signal is asserted, and to close if the switch control signal is unasserted.

18. The circuit of claim 17, wherein the pre-determined amount is a value from about 50 milliVolts to about 200 milliVolts.

19. A circuit for operation with a low supply voltage, comprising:

a p-type depletion transistor having at least a gate, a drain, a source, and a bulk, wherein the source of the p-type depletion transistor is coupled to a power supply node;

a charge pump circuit having at least an output; and switch circuitry that is arranged such that:

if voltage at the gate of the p-type depletion transistor is relatively close to an upper limit of a voltage swing for the gate voltage the bulk of the p-type depletion transistor is coupled to the output of the charge pump circuit;

else the bulk of the p-type depletion transistor is coupled to the source of the p-type depletion transistor, wherein the charge pump circuit is operable to provide a charge pump output voltage at the output of the charge pump circuit such that the charge pump output voltage is at least about 1.5 times the power supply voltage at the power supply node.

20. The circuit of claim 19, wherein the charge pump voltage is at least twice the power supply voltage, and wherein the charge pump voltage is a multiple of the power supply voltage.

* * * * *

UNITED STATES PATENT AND TRADEMARK OFFICE

CERTIFICATE OF CORRECTION

PATENT NO. : 7,495,506 B1
APPLICATION NO. : 11/232644
DATED : February 24, 2009
INVENTOR(S) : Scott Douglas Carper It is certified that error appears in the above-identified patent and that said Letters Patent is hereby corrected as shown below:

In column 5, line 33, in Claim 4, delete “witch” and insert -- switch --, therefor.

In column 5, line 63, in Claim 7, delete “p-type,” and insert -- p-type --, therefor.

In column 6, line 39, in Claim 9, delete “5” and insert -- 50 --, therefor.

In column 7, line 34, in Claim 15, delete “switching” and insert -- switch --, therefor.

Signed and Sealed this

Twenty-eighth Day of April, 2009

John Doll

JOHN DOLL
*Acting Director of the United States Patent and Trademark Office*